US008087344B2

(12) United States Patent
Siddle et al.

(10) Patent No.: US 8,087,344 B2
(45) Date of Patent: Jan. 3, 2012

(54) RECOIL OPERATING PISTOL WITH NESTABLE BARREL AND SLIDE

(75) Inventors: Kevin Siddle, Millstadt, IL (US); Bruce K. Siddle, Millstadt, IL (US)

(73) Assignee: Double Nickel Holdings, LLC, Millstadt, IL (US)

( * ) Notice: Subject to any disclaimer, the term of this patent is extended or adjusted under 35 U.S.C. 154(b) by 275 days.

(21) Appl. No.: 12/543,767

(22) Filed: Aug. 19, 2009

(65) Prior Publication Data

US 2011/0041375 A1 Feb. 24, 2011

(51) Int. Cl.
*F41A 3/86* (2006.01)
*F41A 21/00* (2006.01)

(52) U.S. Cl. ..... 89/196; 89/14.05; 42/69.02; 42/76.01

(58) Field of Classification Search ..... 89/196, 89/14.05; 42/69.02, 76.01; D22/103, 104
See application file for complete search history.

(56) References Cited

U.S. PATENT DOCUMENTS

| | | | | | |
|---|---|---|---|---|---|
| 37,193 | A | * | 12/1862 | Alsop | 42/78 |
| 176,276 | A | * | 4/1876 | Barnett | 42/76.01 |
| 2,921,503 | A | * | 1/1960 | Browning | 89/195 |
| 3,738,044 | A | * | 6/1973 | Robinson | 42/75.02 |
| 3,894,474 | A | * | 7/1975 | Tanfoglio | 89/148 |
| 3,979,851 | A | * | 9/1976 | Soucy | 42/77 |
| 4,176,584 | A | * | 12/1979 | Thomas, Jr. et al. | 89/138 |
| 4,615,132 | A | * | 10/1986 | Smith | 42/25 |
| 5,415,075 | A | * | 5/1995 | Moon | 89/163 |
| 5,844,162 | A | * | 12/1998 | Renner | 89/14.3 |

* cited by examiner

*Primary Examiner* — Bret Hayes
(74) *Attorney, Agent, or Firm* — Thompson Coburn LLP

(57) ABSTRACT

A recoil operating pistol has a barrel and slide with at least a pair of flat mating surfaces extending along a substantial length of both the barrel and slide parallel to each other on opposite sides of the barrel. The matching flat surfaces of the barrel and slide allow relative sliding motion between the slide and the barrel when the at least a portion of the barrel is received in the hollow interior of the slide.

14 Claims, 9 Drawing Sheets

RECOIL OPERATING PISTOL WITH NESTABLE BARREL AND SLIDE

BACKGROUND

The disclosure pertains to a barrel and slide used in a pistol utilizing principles of recoil for operation.

DETAILED DESCRIPTION

Figure 1:
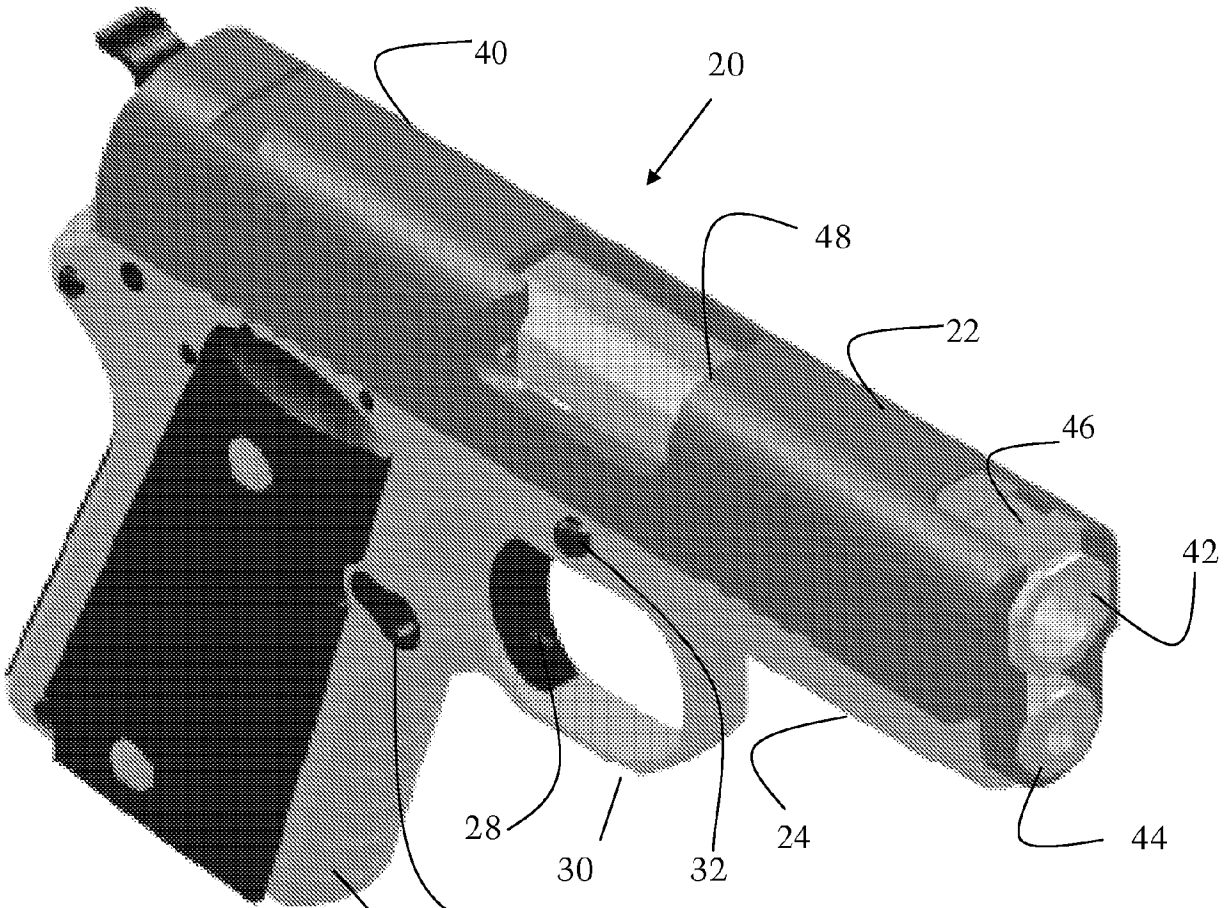
FIG. 1 shows a recoil operating pistol with nestable barrel and slide.
Figure 2:
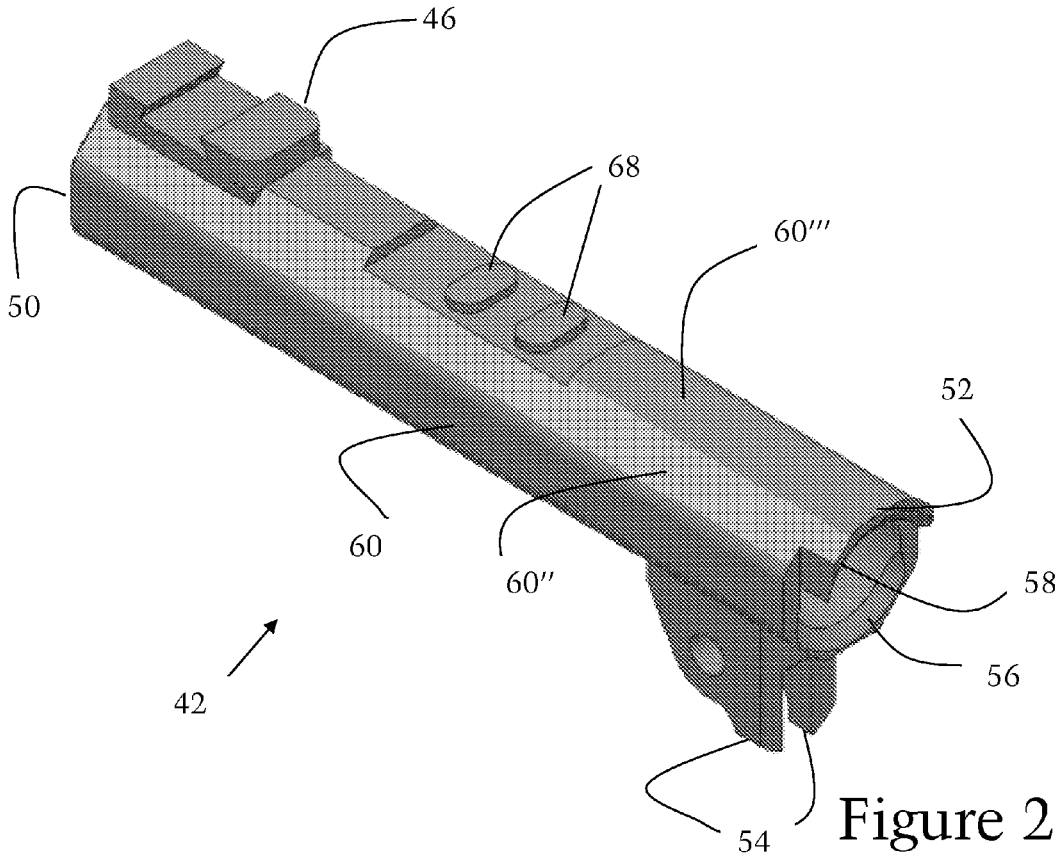
FIG. 2 shows a top perspective view of a barrel of the recoil operating pistol of FIG. 1.

FIG. 1 shows a recoil operating pistol 20 commonly known as a 1911 model with which the nestable barrel and slide described below may be used. The 1911 model pistol 20 has a slide assembly 22 slidably mounted on a frame or receiver 24. The frame 24 has a grip 26, trigger 28, trigger guard 30, slide stop pin 32, and magazine catch 34. The slide assembly 22 includes a slide 40 with a generally hollow interior in which a barrel 42, a recoil plug 44, and sight 46 are disposed. The slide 40 has a cartridge ejection port 48. Although not shown in the drawings, the frame and slide assembly may include other components, such as a recoil spring, recoil spring guide, extractor, firing pin, firing pin spring, firing pin stop, and a slide stop. Although a 1911 model pistol is shown in the drawings, the nestable barrel and slide described below may be used with other styles of recoil operating pistols.

For purposes of illustrating the functionality of the nestable barrel and slide assembly disclosed below, the principles of a recoil operating pistol will be generally described. As the expanding combustion gases force the bullet down the barrel, they give reverse momentum to the slide and barrel which are locked together during this portion of the firing cycle. In the ready to fire position, the slide is locked to barrel and both are fully forward. Upon firing, the slide and the barrel recoil backwards a short distance while locked together, until the barrel is stopped. The slide unlocks from the barrel and continues to move to the rear, ejecting the fired round casing and compressing the recoil spring. The slide returns forward under spring force, loading a new round into the barrel. The slide then locks into barrel, and forces the barrel to return to battery.

The exact method of locking and unlocking the barrel is the primary differentiating factor in the wide array of recoil operating pistol designs. For instance, the 1911 model pistol shown in the drawings uses a tilting barrel designs, based either on the swinging link and locking lugs or the linkless cam design. Upon firing a recoil operating pistol with a swinging link design, the slide and barrel continue rearward a short distance until the link pivots the barrel down, out of the locking recesses of the slide, and brings the barrel to a stop. As the slide continues rearward, a claw extractor pulls the spent casing from the firing chamber and an ejector strikes the rear of the case pivoting it out and away from the pistol. The slide then stops and is then propelled forward by the recoil spring to strip a fresh cartridge from the magazine and feed it into the firing chamber. At the forward end of its travel, the slide locks into the barrel and is ready to fire again. The nestable barrel and slide assembly described below may also be used with a recoil operated pistol having a swinging linking and locking lugs or other common designs, including a locking block design, the use of rollers, a rotating barrel, or a toggle bolt.

Figure 3:
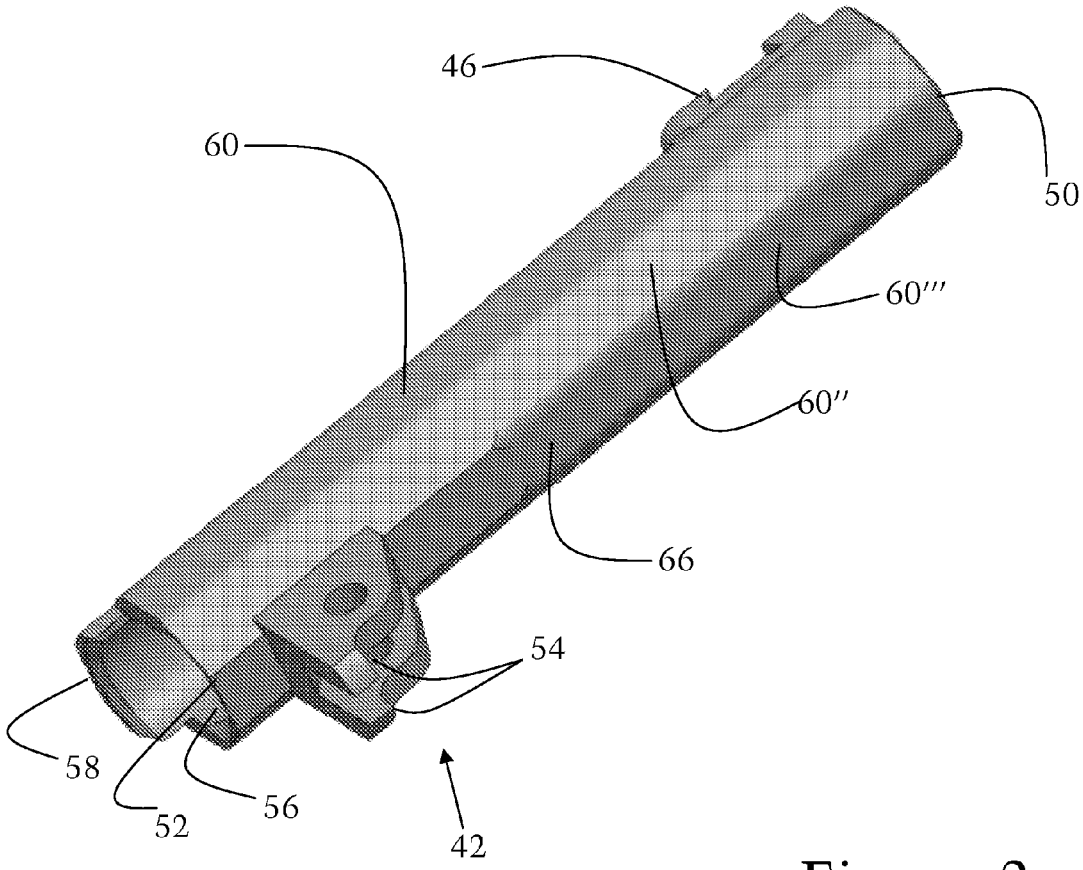
FIG. 3 shows a bottom perspective view of the barrel of FIG. 2.
Figure 4:
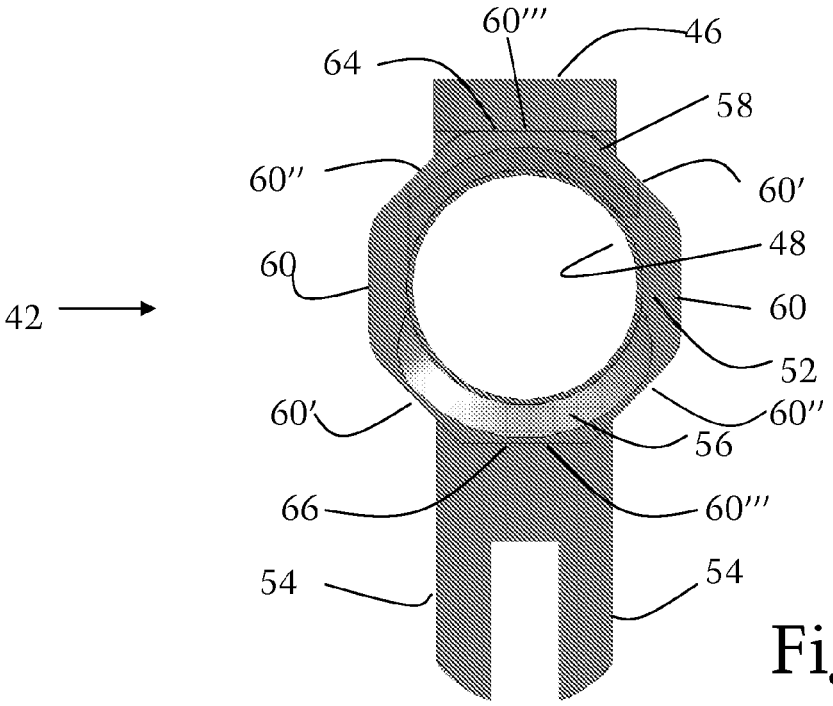
FIG. 4 shows a front view of the barrel of FIG. 2.
Figure 5:
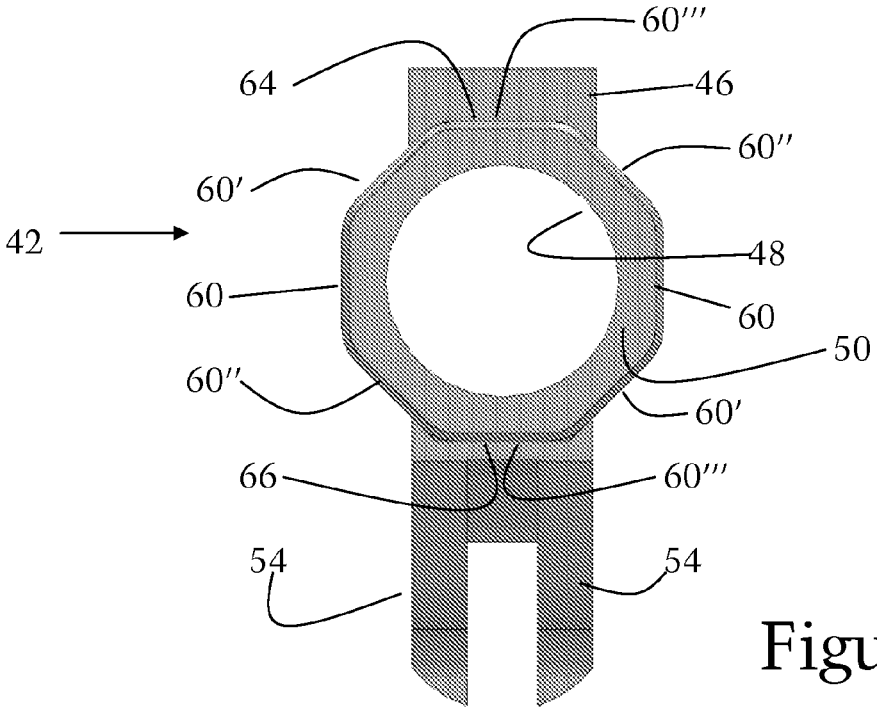
FIG. 5 shows a rear view of the barrel of FIG. 2.
Figure 6:
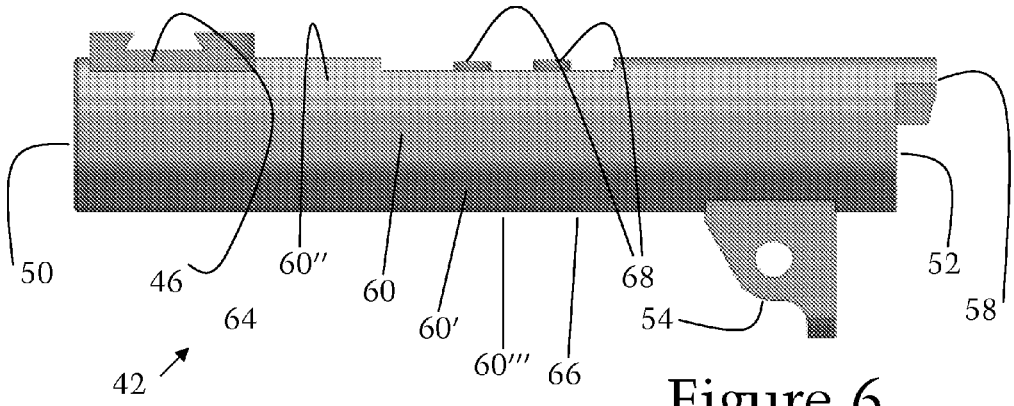
FIG. 6 shows a left view of the barrel of FIG. 2 (the right view is not shown being a mirror image of the view of FIG. 6)
Figure 7:
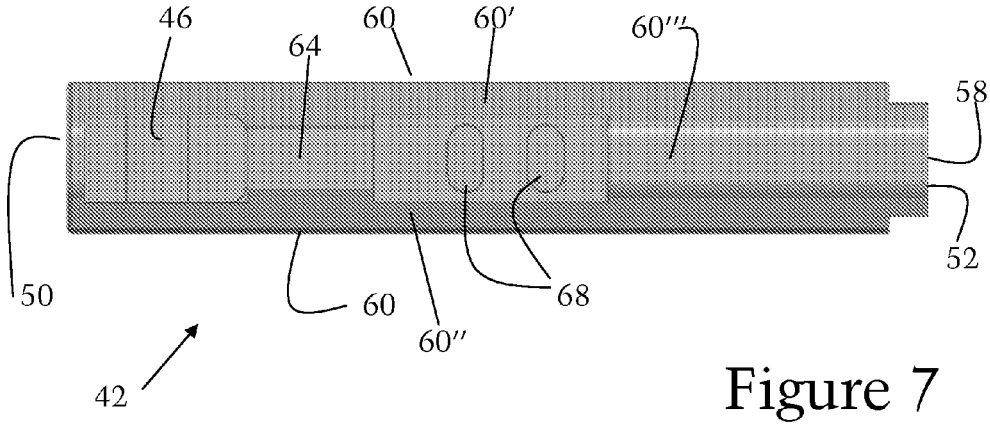
FIG. 7 shows a top view of the barrel of FIG. 2.
Figure 8:
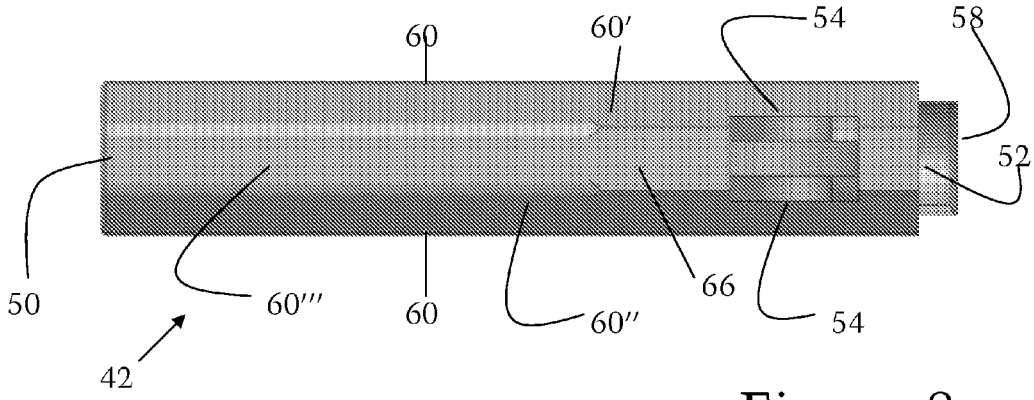
FIG. 8 shows a bottom view of the barrel of FIG. 2.
Figure 9:
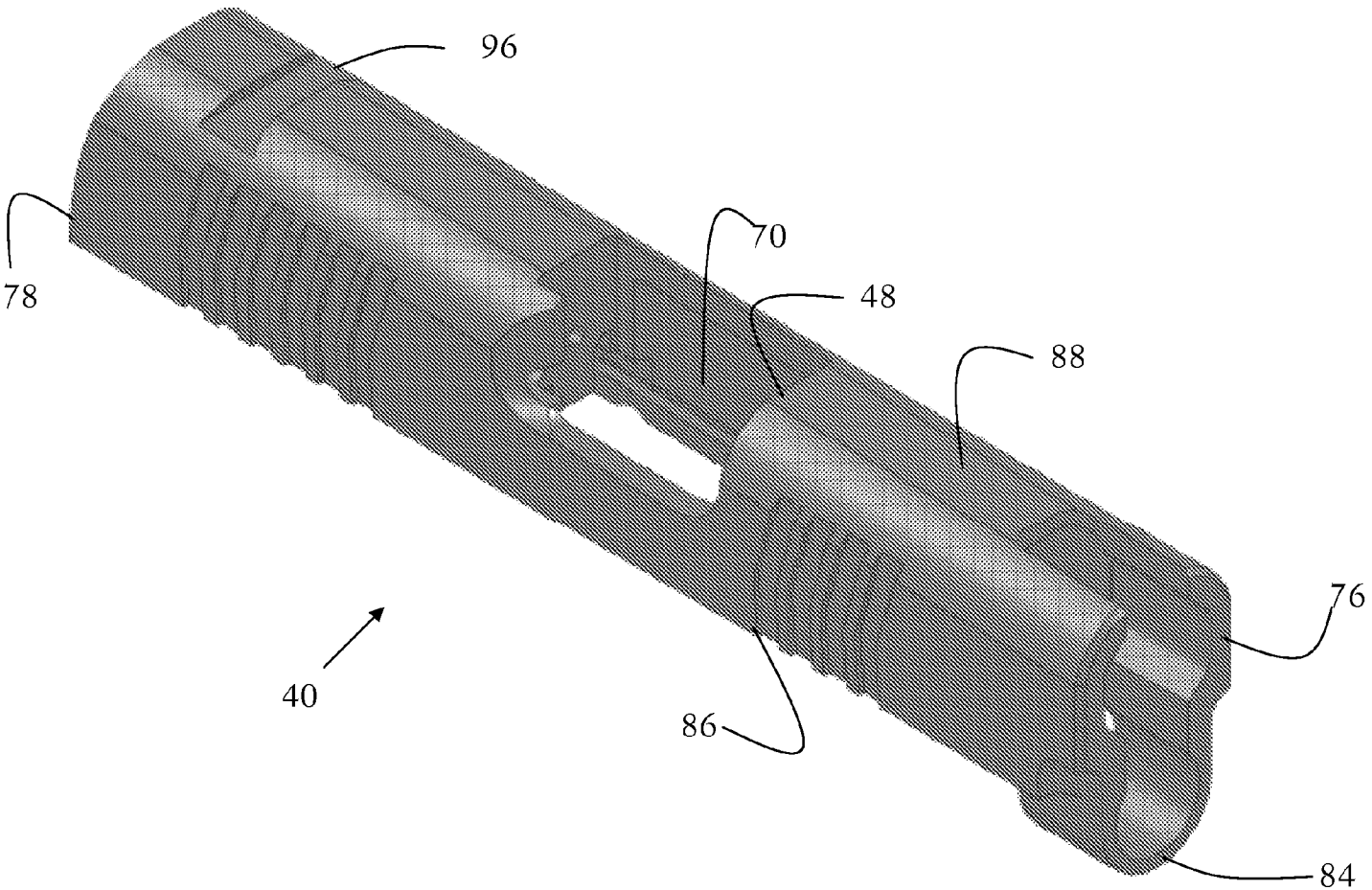
FIG. 9 shows a top perspective view of a slide of the recoil operating pistol of FIG. 1.
Figure 10:
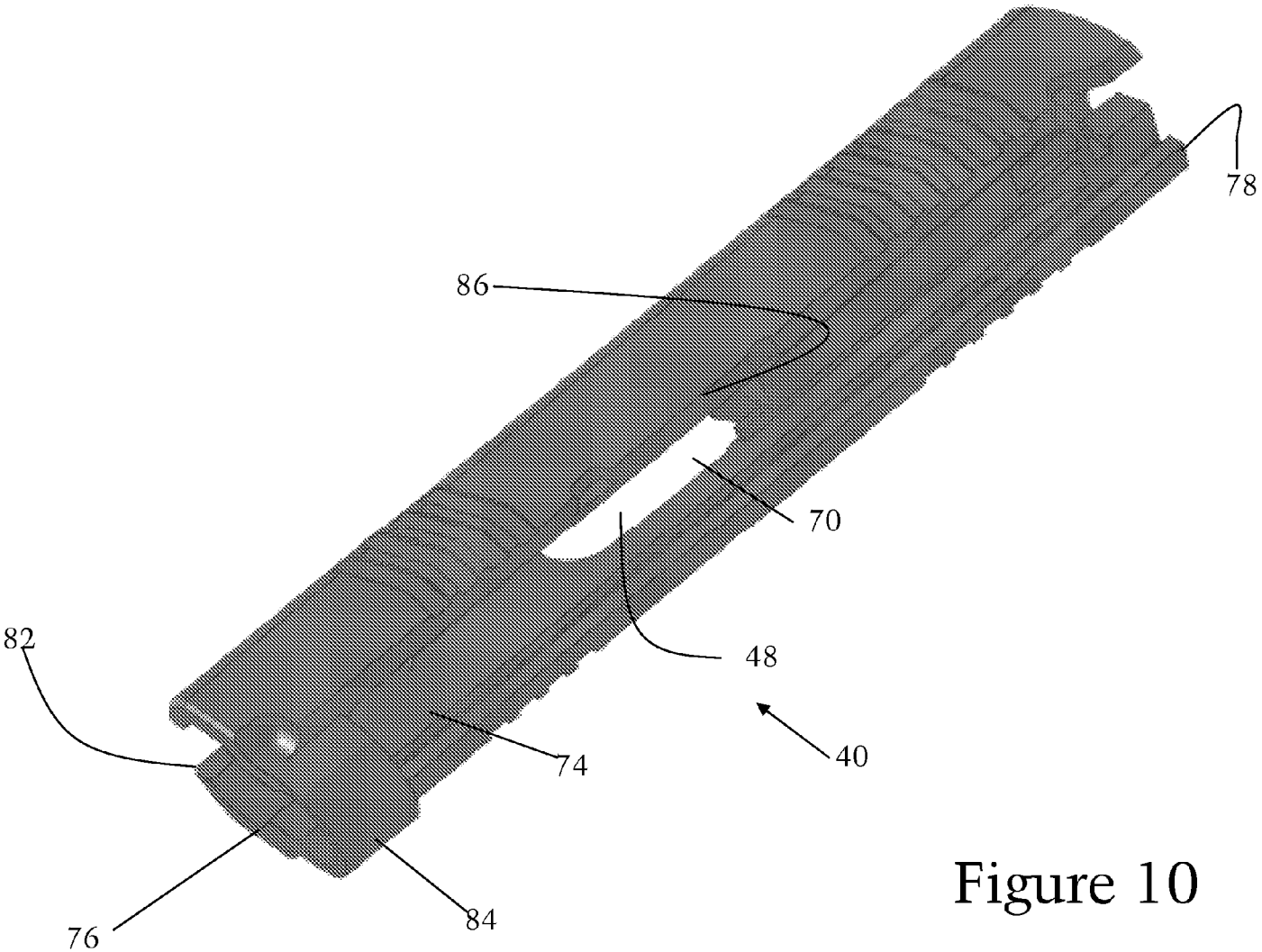
FIG. 10 shows a bottom perspective view of the slide of FIG. 9.
Figure 11:
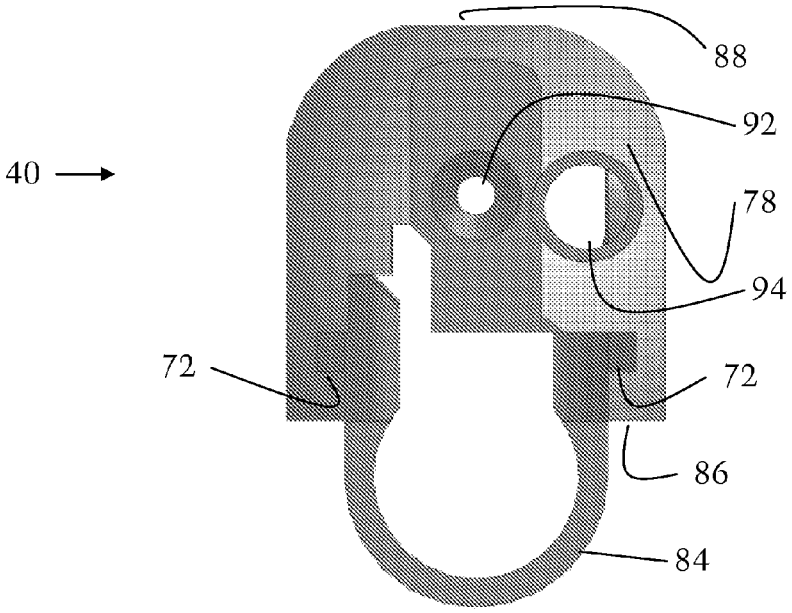
FIG. 11 shows a front view of the slide of FIG. 9.
Figure 12:
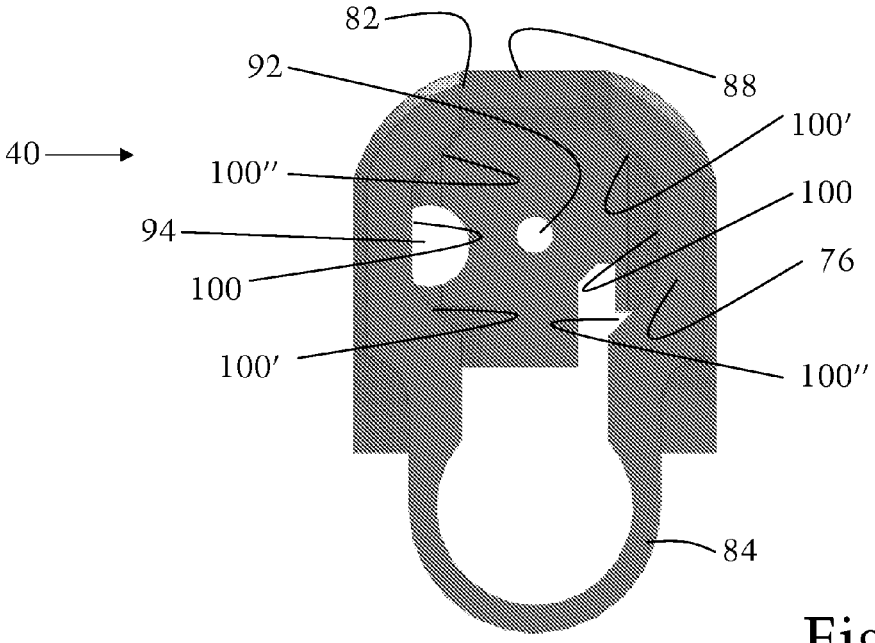
FIG. 12 shows a rear view of the slide of FIG. 9.
Figure 13:
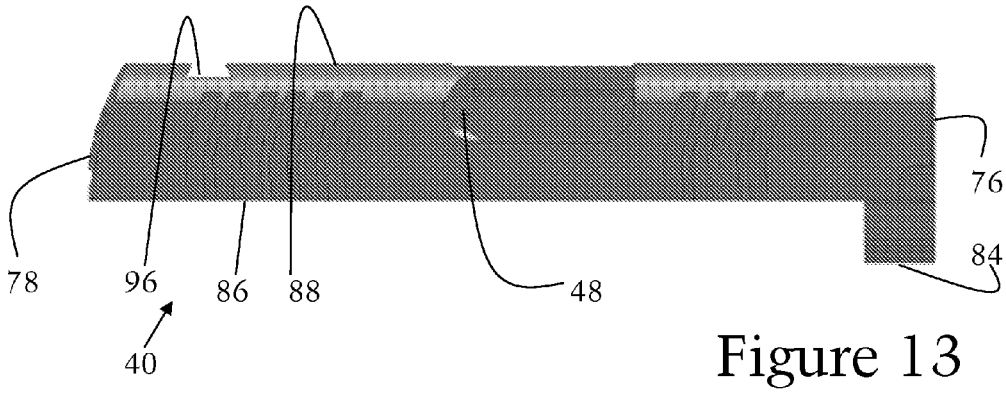
FIG. 13 shows a left view of the slide of FIG. 9 (the right view is not shown being a mirror image of the view of FIG. 13)
Figure 14:
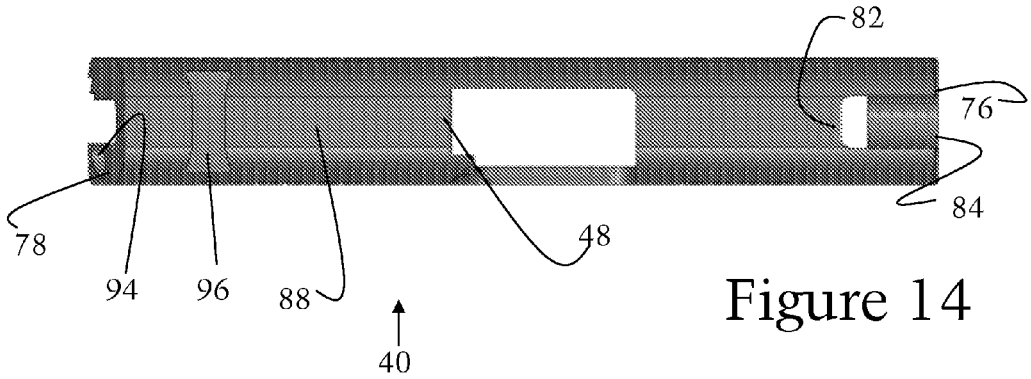
FIG. 14 shows a top view of the slide of FIG. 9.
Figure 15:
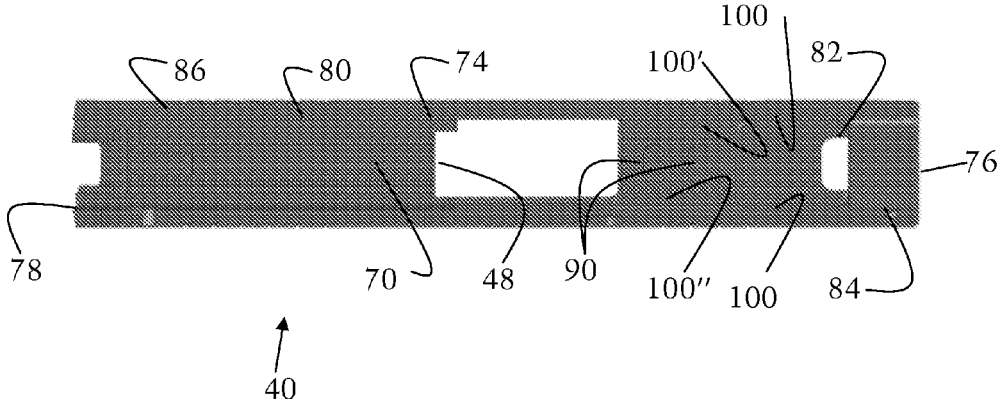
FIG. 15 shows a bottom view of the slide of FIG. 9.

FIGS. 2 through 8 provide further detail of the barrel 42 of the recoil operated pistol. The barrel 42 comprises a tubular member having an interior surface 48 adapted to discharge the projectile from the recoil operated pistol. The interior surface may be provided with rifling and/or gas discharge ports to reduce fouling of the projectile as it is discharged from the recoil operated pistol. A muzzle end 50 of the barrel has the sight 46 mounted thereto and a breech end 52 of the barrel has lugs 54 that engage the slide stop pin 32. The lugs 54 pivot the barrel down thereby unlocking the barrel from the slide, and bring the barrel to a stop after firing the pistol during the first sequence in the recoil operation. The breech end 52 of the barrel has a throat 56 and a hood 58 allowing cartridges to be fed from the magazine into the barrel interior 48. An exterior surface of the barrel is provided with at least a pair of flat surfaces 60 (other flat surfaces that may be provided on the barrel exterior are indicated with reference characters 60', 60", 60'") extending generally longitudinally along the barrel on opposite sides of the barrel. As shown in the drawings, the barrel external flat surfaces are disposed at 45 degree angles about the longitudinal center line of the barrel. Other arrangements may be used. It may be considered that the sight 46 defines a top surface 64 of the barrel, and the lugs define a bottom surface 66 of the barrel. In a preferred embodiment, the pair of flat external surfaces of the barrel are disposed at 90 degree angles from the top surface (+90°/−90°) on opposite sides of the barrel. Radiuses may be provided to extend between the coterminous edges of the flat surfaces. As best shown in FIGS. 3 and 8, the bottom surface of the barrel may have sharp transition edges in the area adjacent the lugs and radiused edges toward the muzzle end. The top surface 64 of the barrel also contains locking lugs 68 which cooperate with the slide to lock the slide and barrel together in the ready-to-fire position and during the first stage of the recoil sequence before the barrel tilts away from the slide allowing the slide to recoil to the rear to eject the fired round casing.

FIGS. 9-15 provide additional detail of the slide 40. The slide 40 comprises a tubular member with a hollow interior 70 with a pair of rails 72 extending longitudinally on an internal surface 74 of the hollow interior 70 from a muzzle end 76 of the slide to a breech end 78 of the slide. The rails 72 allow the slide assembly 22 to move in a reciprocating fashion on the frame 24 of the recoil operating pistol. As shown in the drawings, the slide 40 has a bottom opening 80 extending longitudinally adjacent the rails. The slide cartridge ejection port 48 is opposite the bottom opening 80. The cartridge ejection port allows a spent cartridge to be discharged during the second phase of the recoil sequence. The slide also has a notch 82 at its muzzle end 76 that cooperates with the sight 46 of the barrel 42 allowing the sight of the barrel to extend through the notch when the barrel is received in the hollow interior of the slide. Alternatively, the notch may be eliminated and the sight provide on the muzzle end of the slide. At the muzzle end 76 of the slide, the slide has a recoil spring plug housing 84 that is sized to receive the recoil spring plug 44. It may be considered that the slide bottom opening and recoil spring plug housing define a bottom 86 of the slide and the notch and cartridge ejection port define a top 88 of the slide. On an internal top surface of the slide, locking detents 90 (FIG. 15) are provided to engage the locking lugs 68 of the top surface 64 of the barrel. As explained previously, the detents 90 of the slide engage the locking lugs 68 of the barrel to lock the barrel and slide together during the first stage of the recoil operation and when firing a projectile from the pistol. The breech end of the slide has a firing pin hole 92 and an extractor hole 94. A rear sight locator 96 may also be provided on the slide top at the breech end of the slide.

The slide has at least a pair of flat internal surfaces 100 parallel to one another extending longitudinally and parallel to a longitudinal center line of the slide. As shown in the drawings, one pair of flat internal surfaces of the slide are exposed at 90° angles (+90°/−90°) from the top and bottom of the slide. The slide may be provided with additional flat surfaces disposed between the slide flat internal surfaces. Other flat surfaces that may be provided on the barrel exterior are indicated with reference characters 100', 100". As shown in the drawings, additional flat surfaces may be provided at 45° angles from the top surface (+45°/−45°).

When assembled, the barrel flat external surfaces 60 match with the slide flat internal surfaces 100 allowing the barrel to be nested within the slide and to allow sliding motion between the barrel and slide as is necessary during operation of the recoil operated pistol. The flat surfaces provide a more accurate alignment of the barrel and slide when compared to the traditional round barrel and round bore slide, thereby providing the user with improved accuracy.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed were meant to be illustrative only and not limited as to the scope of the invention which is to be given the full breadth of the appended claims and any and all equivalents thereof.

What is claimed is:

1. A recoil operating pistol comprising:

a barrel having an internal surface adapted for discharging a projectile from the pistol and four pairs of flat external surfaces extending along a substantial length of the barrel with each in the pair being parallel to each other, one surface in the pair of surfaces being opposite to the other of the surface in the pair of surfaces on a diametrically opposite side of the barrel, and each of the surfaces being parallel to a longitudinal centerline of the barrel;

a slide having a generally hollow interior adapted to receive at least a portion of the barrel, the slide hollow interior having flat internal surfaces extending along a substantial length of the slide hollow interior parallel parallel to a longitudinal centerline of the slide, the slide flat internal surfaces being arranged and having dimensions matching the pairs of barrel flat external surfaces in a manner to allow relative sliding motion between the slide and the barrel when the at least a portion of the barrel is received in the hollow interior of the slide;

wherein the barrel and slide are locked together when the pistol is in battery and the barrel is movable relative to a body of the pistol when the pistol is out of battery.

2. The pistol of claim 1, wherein the slide has a notch on a muzzle end of the slide.

3. The pistol of claim 2, wherein the barrel has a sight on a muzzle end of the barrel.

4. The pistol of claim 1, wherein the pistol is a 1911 style pistol.

5. The pistol of claim 1, wherein the barrel has a generally octagonal exterior cross sectional shape.

6. A recoil operating pistol comprising:

a barrel having an internal surface adapted for discharging a projectile from the pistol and at least a pair of flat external surfaces extending along a substantial length of the barrel parallel to each other on opposite sides of the barrel and parallel to a longitudinal centerline of the barrel;

a slide having a generally hollow interior adapted to receive at least a portion of the barrel, the slide hollow interior having at least a pair of flat internal surfaces extending along a substantial length of the slide hollow interior parallel to each other on opposite sides of the slide interior and parallel to a longitudinal centerline of the slide, the at least a pair of slide flat internal surfaces having dimensions matching the at least a pair of barrel flat external surfaces in a manner to allow relative sliding motion between the slide and the barrel when the at least a portion of the barrel is received in the hollow interior of the slide;

wherein the slide has a notch on a muzzle end of the slide;

wherein the barrel has a sight on a muzzle end of the barrel; and wherein the barrel sight extends through the slide notch.

7. The pistol of claim 6, wherein the barrel sight defines a top of the barrel and the at least a pair of the barrel flat external surfaces are on opposing sides of the barrel each about 90 degrees from the barrel top.

8. The pistol of claim 7, wherein the barrel has additional flat external surfaces extending longitudinally disposed between the barrel sides and the barrel top.

9. The pistol of claim 6, wherein the slide has rails adapted to engage a frame of the pistol and a bottom opening extending along a substantial portion of its length adjacent the rails.

10. The pistol of claim 9, wherein the at least a pair of slide flat internal surfaces are arranged perpendicular to a plane defined by the slide bottom opening.

11. The pistol of claim 6, wherein the pistol is a 1911 style pistol.

12. The pistol of claim 6, wherein the barrel has a generally octagonal exterior cross sectional shape.

13. A barrel for a recoil operating pistol comprising:

an internal surface adapted for discharging a projectile from the pistol;

a sight on a muzzle end of the barrel defining a top of the barrel;

a lug on an end of the barrel opposite the muzzle end and opposite the barrel top defining the barrel bottom;

the barrel top having a substantially flat external surface extending along a substantial length of the barrel;

the barrel bottom having a substantially flat external surface extending along a substantial length of the barrel, the barrel bottom flat external surface being parallel to the barrel top external surface;

side flat external surfaces extending along a substantial length of the barrel parallel to each other on opposite sides of the barrel and parallel to a longitudinal centerline of the barrel, the side external surfaces being on opposing sides of the barrel each about 90 degrees from the barrel top and bottom flat external surfaces;

four angled flat external surfaces extending along a substantial length of the barrel parallel to a longitudinal centerline of the barrel, each of the angled flat external surfaces being angled to the side flat external surfaces and spaced about the external surface of the barrel in a manner such that together the top and bottom flat external surfaces, the side flat external surfaces, and the angled flat external surfaces form a generally octagonal exterior cross section for the barrel; and wherein the top and bottom flat external surfaces, the side flat external surfaces, angled flat external surfaces are dimensioned to be received in a hollow interior of a slide of the recoil operating pistol for relative sliding motion therebetween when at least a portion of the barrel is received in the slide; and wherein the barrel has engagement surfaces on at least one its exterior surfaces configured to lock with the slide when the pistol is in battery and to unlock with the slide when the pistol is out of battery.

14. A slide for a recoil operating pistol comprising:

a notch on a muzzle end of the slide defining a top of the slide;

a generally hollow interior with a top interior surface at the top of the slide being substantially flat and extending along a substantial length of the slide;

a pair of side flat internal surfaces on opposing sides of the slide each about 90 degrees from the slide top interior surface;

four angled flat interior surfaces extending along a substantial length of the slide parallel to a longitudinal centerline of the barrel, each of the angled flat external surfaces being angled to the side flat interior surfaces and spaced about the hollow interior of the slide in a manner such that together the top flat interior surface, the side flat interior surfaces, and the angled flat interior surfaces form a generally octagonal interior cross section for the slide hollow interior; and wherein the top flat interior surfaces, the side flat interior surfaces, and the angled flat interior surfaces are dimensioned to receive a barrel of the recoil operating pistol in the slide hollow interior with relative sliding motion therebetween when at least a portion of the barrel is received in the slide; and wherein the slide has engagement surfaces on at least one of its interior surfaces configured to lock with the barrel when the pistol is in battery and to unlock with the barrel when the pistol is out of battery.

* * * * *